US006975823B2

(12) United States Patent
Onishi et al.

(10) Patent No.: US 6,975,823 B2
(45) Date of Patent: Dec. 13, 2005

(54) IMAGE FORMING APPARATUS INCLUDING A PRECHARGING DEVICE

(75) Inventors: Akihito Onishi, Tokyo (JP); Takao Mizutani, Tokyo (JP); Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/647,285

(22) Filed: Aug. 26, 2003

(65) Prior Publication Data

US 2004/0042821 A1 Mar. 4, 2004

(30) Foreign Application Priority Data

Aug. 27, 2002 (JP) ..... 2002-246714

(51) Int. Cl.[7] ..... G03G 21/00

(52) U.S. Cl. ..... 399/128; 399/129; 399/148; 399/350

(58) Field of Search ..... 399/127–129, 399/148, 349–351, 353, 35

(56) References Cited

U.S. PATENT DOCUMENTS 4,640,599 A * 2/1987 Doutney ..... 339/354
5,911,097 A * 6/1999 Haga et al. ..... 399/128
6,026,259 A * 2/2000 Yamaki et al. ..... 399/128
6,144,824 A * 11/2000 Hashimoto et al. ..... 399/128
6,233,416 B1 * 5/2001 Kinosita et al. ..... 399/128
6,442,362 B2 * 8/2002 Hirabayashi et al. ..... 399/129
6,591,075 B2 * 7/2003 Koiso et al. ..... 399/351
6,640,070 B2 * 10/2003 Sanmonji ..... 399/350

FOREIGN PATENT DOCUMENTS

JP 06-130778 5/1994

* cited by examiner

*Primary Examiner*—William J. Royer
(74) *Attorney, Agent, or Firm*—Rabin & Berdo, P.C.

(57) ABSTRACT

An image forming apparatus includes an image carrier rotatable in a predetermined rotative direction, a charging unit for charging a surface of the image carrier, a precharging device disposed upstream from the charging unit with respect to the predetermined rotative direction of the image carrier for precharging the surface of the image carrier; and a voltage supply unit for supplying a voltage to the precharging device.

21 Claims, 10 Drawing Sheets

FIG.8(a) AFTER TRANSFERRING PROCESS

FIG.8(b) AFTER PRECHARGING PROCESS

FIG.8(c) AFTER THE NEXT CHARGING PROCESS

IMAGE FORMING APPARATUS INCLUDING A PRECHARGING DEVICE

FIELD OF THE INVENTION

The present invention relates to an image forming apparatus such as an electrophotographic printer, a facsimile machine and a copier, and specifically relates to a structure of a cleaning unit of such an image forming apparatus for scraping residual toner from a surface of a photoconductor after completion of an electrification process on the surface of the photoconductor and a toner transference process.

BACKGROUND OF THE INVENTION

The invention overcomes problems as explained below.

CONVENTIONAL PARTS OF THE INVENTION

FIG. 9 is a schematic side view of an image forming apparatus 50 having a conventional cleaning unit. A photoconductive drum 51 serving as an image carrier is installed in a not-illustrated chassis as well as a not-illustrated driving unit that drives the photoconductive drum 51 to rotate in the direction of the arrow A. A charging roller 52 for charging the periphery 51*a* of the photoconductive drum 51, an LED head 53 for irradiating the charged periphery 51*a* with an image beam to form an electrostatic latent image, and a developing roller 55 for causing the toner adhere to the latent image are disposed around the photoconductive drum 51.

A developing unit 56 is comprised of the developing roller 55, a toner supply roller 57 for supplying the developing roller 55 with the toner 54, and a not-illustrated toner cartridge storing the toner 54 to be supplied to the toner supply roller 57 and the developing roller 55. A transferring roller 58 and a cleaning unit 59 are disposed downstream form the developing roller 55. The transferring roller 58 receives at its rotation axis a certain pressure from a not-illustrated spring, so that its periphery is pressed against the periphery 51*a* of the photoconductive drum 51.

The charging roller 52 forming a charging unit 61 is comprised of a metal shaft 52*a* and a roller 52*b* that includes an elastic semiconductive rubber layer formed on the metal shaft 52*a*, and a resin coat or a surface-modifying layer formed on the elastic semiconductive rubber layer. The charging unit 61 presses the charging roller 52 against the photoconductive drum 51 so that the charging roller 52 rotates following the photoconductive drum 51, or rotates at a different speed. The charging unit 61 is powered by a dedicated power source 62 and applies the metal shaft 52*a* with a d.c. (or a.c+d.c.) voltage.

The operation of the image forming apparatus having the above-described structure will be explained.

When the photoconductive drum 51 is driven at a constant speed in the direction of the arrow A by the not-illustrated driving unit, it receives charge from the charging roller 52 so that the periphery 51*a* of the photoconductive drum 51 becomes charged uniformly.

When the LED head 53 irradiates the charged periphery 51*a* of the photoconductive drum 51 with an image beam, a portion that has been applied with this image beam is discharged. Accordingly there arises a potential difference between the portion that has been applied with the image beam and a portion that has not been applied with the image beam, so an electrostatic latent image is formed.

This electrostatic latent image comes around to a position where it faces the developing roller 55 of the developing unit 56 with further rotation of the photoconductive drum 51 in the direction of the arrow A. At this position, the toner 54 charged in the same polarity as the charged surface of the photoconductive drum 51 adheres to the electrostatic latent image corresponding to the portion that has been applied with the image beam by coulombic attraction, so that the latent image becomes a visible image.

At that time, the transferring roller 58 rotates at the same peripheral velocity as the photoconductive drum 51 in the direction shown by the arrow B. As previously stated, the transferring roller 58 and the photoconductive drum 51 are disposed such that they press each other so that good contact can be kept between them.

On the other hand, a not-illustrated paper-supply unit carries recording paper 60 to a position in between the photoconductive drum 51 and the transferring roller 58 in synchronization with the rotation of the photoconductive drum 51. When the front end of a recording paper 60 reaches the contact point of the photoconductive drum 51 and the transferring roller 58, it is pinched between them and conveyed in the direction shown by the arrow C to meet the electrostatic latent image on the photoconductive drum 51. At this time, timing adjustment is made in order that a desired part of the recording paper 60 meets this latent image.

The transferring roller 58 gives charge of the polarity opposite to that of the toner 54 to the back of the recording paper 60 while it is conveyed. As a result, when the recording paper 60 meets the latent image in the photoconductive drum 51, the toner 54 that has adhered to the latent image is attracted by the charge of the opposite polarity, and accordingly, the toner image on the periphery 51*a* of the photoconductive drum 51 is transferred to the recording paper 60. After that, the recording paper 60 bearing the toner image is applied with pressure and heat in a not-illustrate fixing unit to fix the toner image for completing a series of printing operations.

The conventional cleaning unit 59 will be explained with reference to FIG. 9.

The cleaning unit 59 includes a rubber piece 59*b* having a thickness of 1 mm to 3 mm fixed to a metal holder 59*a*. By pressing the edge of the rubber piece 59*b* (referred to as a cleaning blade hereinafter) against the periphery 51*a* of the photoconductive drum 51 at a certain angle, residual toner can be scraped off the periphery 51*a*. For the cleaning blade 59*b*, urethane rubber having excellent properties in elasticity, friction, and endurance can be used.

This cleaning blade 59*b* extends in the direction of the axis of the photoconductive drum 51 to cover the whole width of the photoconductive drum 51. A toner receiver 59*c* integral with the metal holder 59*a* is disposed under the cleaning blade 59*b*. A toner carrying spiral 63 having a rotation axis in parallel with that of the photoconductive drum 51 is disposed inside the toner receiver 59*c*. Waste toner within the toner receiver 59*c* can be carried in a desired direction by rotating the toner carrying spiral 63.

The conventional image forming apparatus described above is configured to charge the periphery of the photoconductive drum 51 to raise its potential that has bee lowered to nearly 0 V after exposing and transferring processes to a certain value only by use of the charging device 61. Accordingly, the potential difference between the charging roller 52 and the periphery 51*a* of the photoconductive drum 51 is large, and therefore a large current flows between them. As a result, there arises a problem that a voltage drop in the rubber layer of the charging roller 52 is not negligible and the charging voltage therefore lowers, so the periphery 51*a* of the photoconductive drum 51 cannot be charged to a desired potential.

This problem invites the so-called ghost phenomenon of a photoconductive drum cycle, in which beam-exposed parts appear as density-increased parts of an image one cycle after (referred to as "OPC (Organic Photo Conductor) cyclic incidental image" hereinafter).

The reason why the OPC cyclic incidental image occurs will be explained with reference to FIGS. 10(*a*) to 10(*c*). FIG. 10(*a*) schematically shows potentials of exposed areas and unexposed areas on the periphery 51*a* of the photoconductive drum 51 after execution of the exposing process. As shown in FIG. 10(*a*), not only the unexposed areas but the exposed areas bear charge in some degree.

FIG. 10(*b*) shows potentials of the exposed areas and unexposed areas after execution of the transferring process. It is apparent from FIG. 10(*b*) that the potential of the exposed areas falls to nearly 0 V, while the potential of the unexposed areas does not fall to that extent and they still bear 20% of the supplied charge.

FIG. 10(*c*) shows potentials of the exposed areas and unexposed areas after the periphery 51*a* is charged again by the charging unit 61. At this time, the potential of the unexposed areas rises to a desired level. However, the potential of the last exposed areas does not rise to the desired value for the reason described above. This becomes a cause of the OPC cyclic incidental image.

Recently, the problem of the OPC cyclic incidental image is becoming serious, because the OPC cyclic incidental image becomes conspicuous as the rotation speeds of the photoconductive drum 51 and the charging roller 52 increase, and accordingly a large charging current flows causing the periphery of the photoconductive 51 drum to be charged incompletely due to the aforementioned voltage drop. This problem is also exacerbated by increase of resolution of such an image forming apparatus 50 to, for example, 1200 dpi.

SUMMARY OF THE INVENTION

An object of the invention is to solve the above-described problem of the OPC cyclic incidental image in the image forming apparatus by eliminating incomplete electrification on the periphery of a photoconductive drum.

This object is achieved by an image forming apparatus including an image carrier rotatable in a predetermined rotative direction, a charging unit for charging a surface of the image carrier, a precharging device disposed upstream from the charging unit with respect to the predetermined rotative direction of the image carrier for precharging the surface of the image carrier, and a voltage supply unit for supplying a voltage to the precharging device.

BRIEF DESCRIPTION OF THE DRAWINGS

Embodiments of the invention will now be described by way of example and with reference to the accompanying drawings in which:

FIG. 2(*b*) shows a principal part of the cleaning unit of the first embodiment on large scale;

FIG. 4(*b*) shows a principal part of the cleaning unit of the fourth embodiment on large scale;

FIG. 5(*b*) shows a principal part of the cleaning unit of the variant of the fourth embodiment on large scale;

FIG. 7(*b*) is a perspective view of a metal plate of the cleaning unit of the sixth embodiment;

DESCRIPTION OF THE PREFERRED EMBODIMENTS

A First Embodiment.

Figure 1:
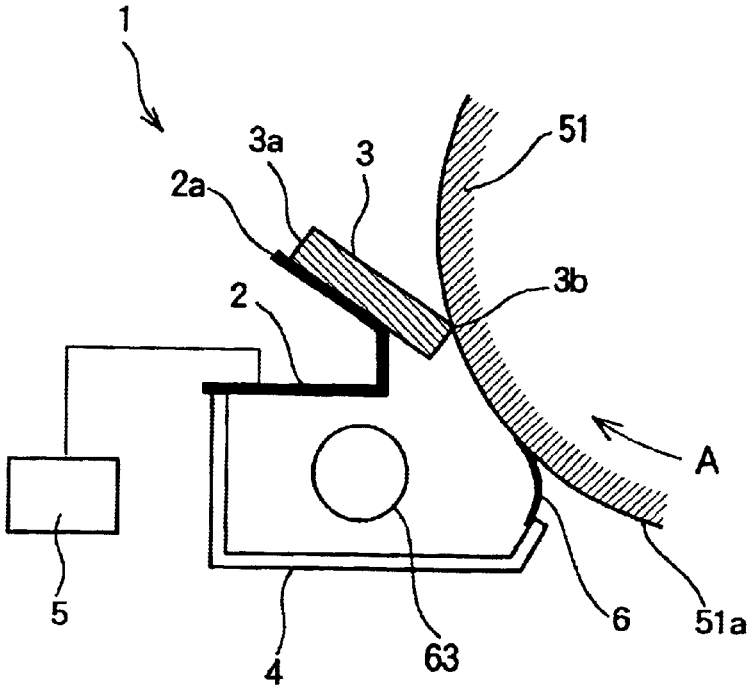
FIG. 1 is a section view schematically showing a structure of a cleaning unit for use in an image forming apparatus of a first embodiment according to the invention.

FIG. 1 is a section view schematically showing a structure of a cleaning unit 1 for use in an image forming apparatus of a first embodiment according to the invention.

This cleaning unit 1 can replace the cleaning unit 59 of the image forming apparatus 50 described above with reference to FIG. 9. without changing other units and elements. Accordingly, the cleaning unit 1 will be described supposing that it is disposed in the image forming apparatus 50 shown in FIG. 9, and detailed explanation of each of the parts of the image forming apparatus 50 will be omitted except the cleaning unit 1 and other parts associated with this cleaning unit 1 in the interest of simplicity.

Figure 9:
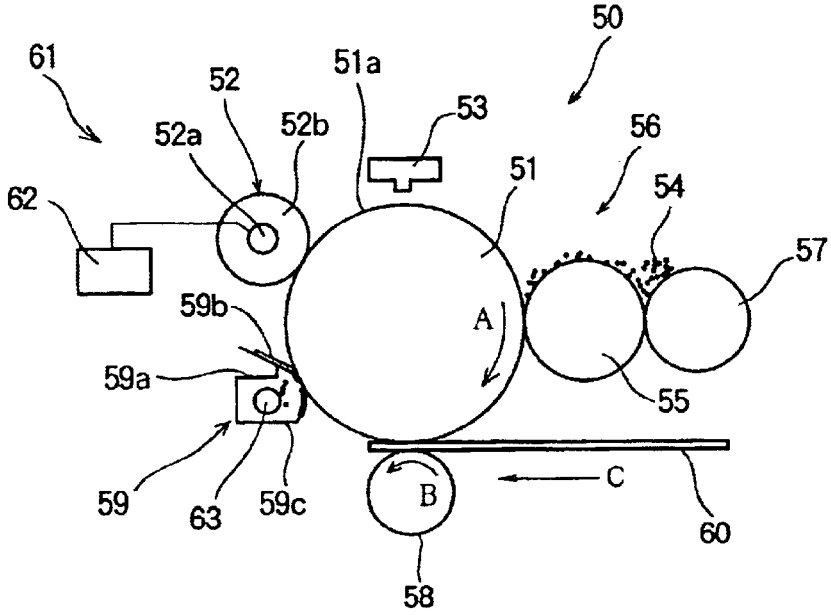
FIG. 9 is a section view schematically showing a structure of an image forming apparatus having a conventional cleaning unit.
Figures 10A, 10B, 10C:
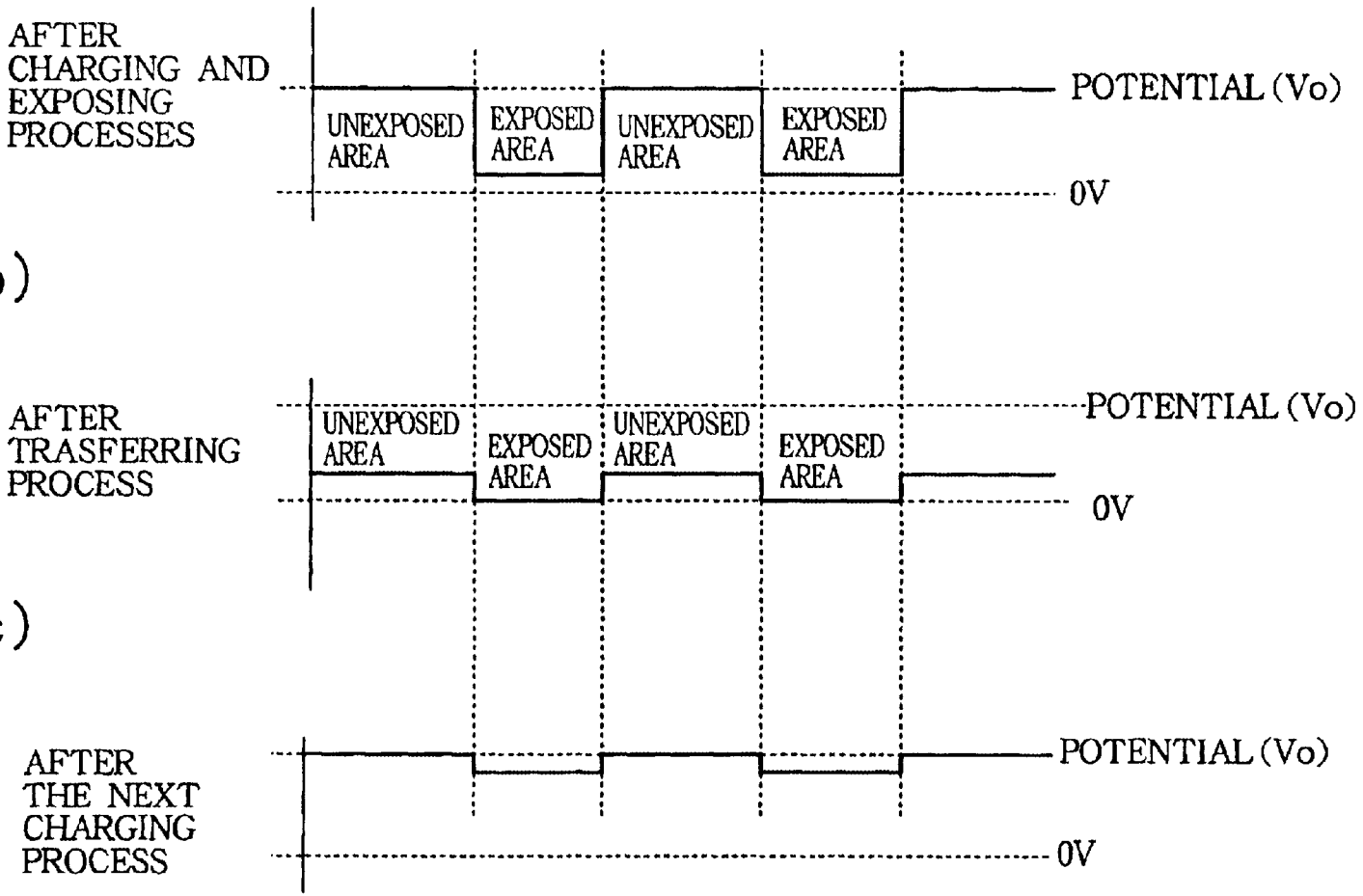
FIGS. 10(*a*) to 10 (*c*) are explanatory diagrams explaining the process for charging the periphery of a photoconductive drum in which the OPC cyclic incidental image is caused.

As shown in FIG. 1, the cleaning unit 1 includes a metal holder 2 disposed in the vicinity of the photoconductive drum 51 serving as an image carrier so as to extend in the direction of the axis of the photoconductive drum 51 to cover the whole width of the photoconductive drum 51 (as in the case of the cleaning unit 59 shown in FIG. 9). Fixed to an incline 2*a* of the metal holder 2, is an edge 3*a* of a cleaning blade 3 having a thickness of 1 mm to 3 mm made of semiconductive urethane rubber that extends substantially for the whole width of the photoconductive drum 51. The other edge 3*b* presses the periphery 51*a* of the photoconductive drum 51. This cleaning blade 3 serves as an auxiliary charging unit.

A toner receiver 4 of L-shape cross section integral with the metal holder 2 is disposed under a contact point where the edge 3*b* and the periphery 51*a* of the photoconductive drum 51 press each other for receiving the toner falling from the contact point. A toner-leakage preventing film 6 extends from an edge of the bottom of the toner receiver 4. The front end of the toner-leakage preventing film 6 is tangent to the periphery 51*a* of the photoconductive drum 51.

Like the cleaning unit 59 shown in FIG. 9, the toner carrying spiral 63 is disposed inside the toner receiver 4 for carrying waste toner accumulated within the toner receiver 4 in a desired direction.

The semiconductive urethane rubber forming the cleaning blade 3 contains carbon black to exhibit resistivity of 106 Ω cm–1010 Ω cm. The metal holder 2 and the cleaning blade 3 made of the semiconductive urethane rubber are fixed to each other in an electrically interconnected state. A dedicated power supply 5 of the cleaning unit 1 that serves as a voltage supplying unit applies a d.c. voltge (or d.c.+a.c. voltage) to the cleaning blade 3 made of the semiconductive urethane rubber through a wiring connected to the metal holder 2. Since the d.c. voltge (or d.c.+a.c. voltage) is supplied to the cleaning blade 3 through the metal holder plate 2, the cleaning blade 3 is applied with the voltage uniformly.

The operation of the image forming apparatus of the first embodiment having the above-described structure will be explained.

The toner that has adhered to the periphery 51*a* of the photoconductive drum 51 is scraped by the edge 3*b* of the cleaning blade 3 and falls into the toner receiver 4 when it reaches the contact point where the periphery 51*a* of the photoconductive drum 51 and the edge 3*b* of the cleaning blade 3 press each other. The waste toner accumulated within the toner receiver 4 is carried in a certain direction by the toner spiral 63 rotating inside the toner receiver 4 and discharged from the toner receiver 4.

On the other hand, the edge 3*b* of the cleaning blade 3 applied with the voltage by the dedicated power supply 5 charges the periphery 51*a* of the photoconductive drum 51 in a contact manner at the contact point between the periphery 51*a* of the photoconductive drum 51 and the edge 3*b* of the cleaning blade 3.

This preliminary electrification on the peripheral 51*a* of the photoconductive drum 51 performed by the edge 3*b* of the cleaning blade 3 satisfies the following expression (1).

$$100V|Vo|-|Va|50V \quad (1)$$

where V0 is the potential of the periphery 51*a* developed by the electrification performed by the charging unit 61 shown in FIG. 9, and Va is the potential of the periphery 51*a* developed by the electrification performed by the cleaning blade 3.

If the above condition is satisfied, the difference between the potential of the exposed areas of the periphery 51*a* of the photoconductive drum 51 that has fallen to nearly 0 V after an overall exposure and the potential of those areas developed by being subject to the electrification by the charging unit 61 can be within 100 V. As a result, the downstream charging unit 61 can charge the periphery 51*a* of the photoconductive drum 51 to a desired potential without causing the above-described OPC cyclic incidental image.

The process in which the periphery 51*a* of the photoconductive drum 51 is charged without causing the OPC cyclic incidental image will be explained with reference to FIGS. 8(*a*) to 8(*c*).

Figure 8:
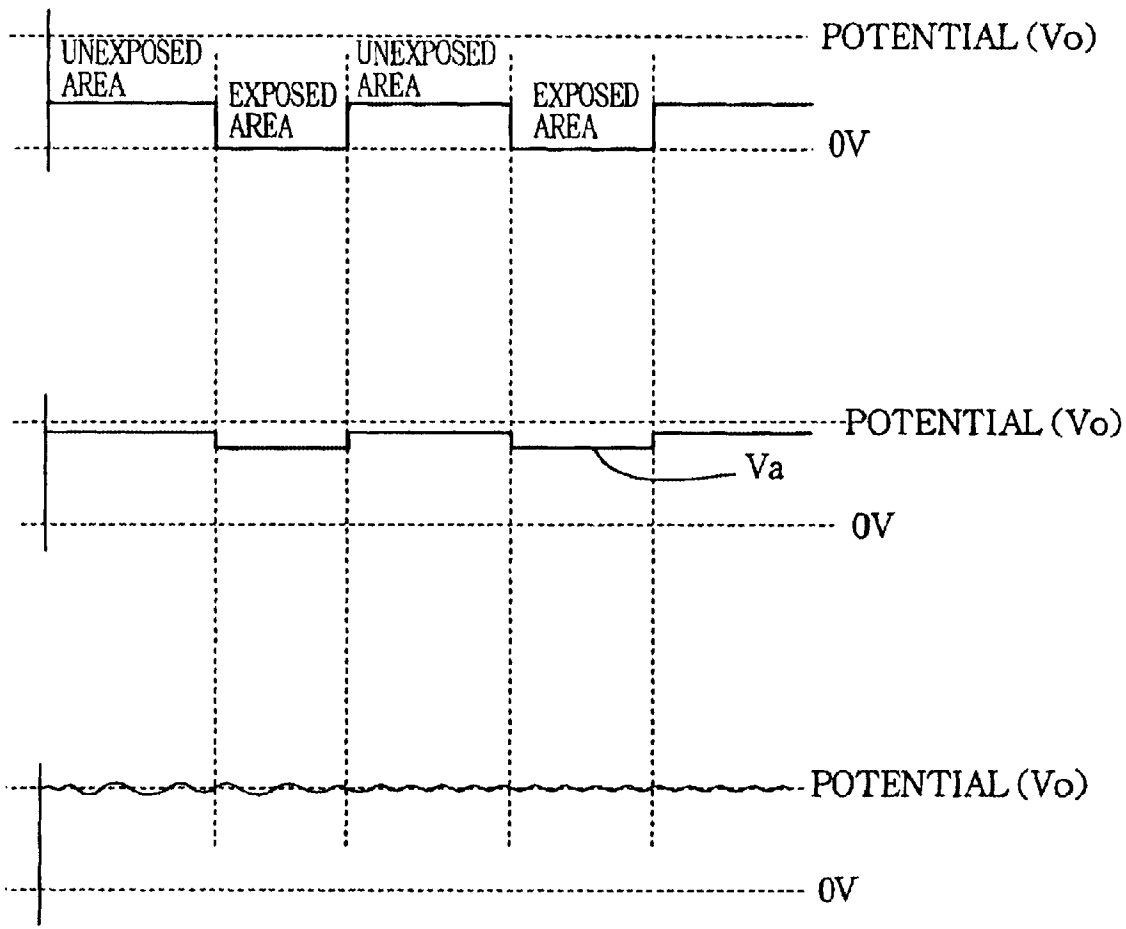
FIGS. 8(*a*) to 8(*c*) are explanatory diagrams explaining the process for charging the periphery of a photoconductive drum without causing the OPC cyclic incidental image.

FIG. 8(*a*) schematically shows potentials of the exposed areas and unexposed areas of the periphery 51*a* of the photoconductive drum 51 after execution of the transferring process. As shown in FIG. 8(*a*), the potential of the exposed areas falls to nearly 0 V, while the potential of the unexposed areas does not fall to that extent and they still bear 20% of the supplied charge.

FIG. 8(*b*) shows the potentials of the exposed areas and unexposed areas after execution of the preliminary electrification by the cleaning blade 3. It is desirable that the surface potentials of the exposed areas and unexposed areas are within the range satisfying the expression (1).

FIG. 8(*c*) shows the potentials of the exposed areas and unexposed areas after execution of a second electrification by the charging unit 61. Not only the unexposed areas but the last exposed areas as well are charged to the desired potential on the strength of the preliminary electrification, thereby avoiding the OPC cyclic incidental image.

It has been found through experiment that if the value of |Vo|–|Va| exceeds 100 V, the OPC cyclic incidental image occurs.

On the other hand, for enabling the charging unit 61 to charge the periphery of the photoconductor drum 51 uniformly and stably, it is desirable that the surface potential Va of the photoconductor drum 51 before reaching the charging unit 61 is lower than the surface voltage V0 after passing the charging unit 61 by at least 50 V.

The reason for that will be explained below. The charging unit 61 performs electrification by use of the charging roller 52 in a desirable environment where temperature and humidity are controlled. Accordingly, in the charging process by the charging unit 61, electrification is carried out stably and uniformly. On the other hand, the cleaning unit 1 is strictly for the purpose of scraping the toner, and therefore it uses a specific member (the cleaning blade 3) that serves this purpose. Accordingly, it is difficult for the cleaning unit 1 to perform electrification stably and uniformly.

So, in this embodiment, the charging unit 61 operates as a workhorse for the electrification on the photoconductive drum 51, and the cleaning unit 1 is no more than an auxiliary charging unit that operates for reducing the potential difference between the exposed areas and the unexposed areas to satisfy the expression (1).

It has been found through experiment that if the value of |Vo|–|Va| is smaller than 50 V, the photoconductive drum 51 cannot be charged uniformly.

Accordingly, in this embodiment, V0 is set to −620 V and Va is set to −570 V.

Table 1 shows performances of the conventional image forming apparatus shown in FIG. 9 and the image forming apparatus of this first embodiment according to the invention in each of the items "Cleaning Capability", "Independent Charging Capability", "Rubber Durability, and "Resistivity to OPC cyclic Incidental Image".

The item "Cleaning Capability" is for making an assessment of the capability of scraping the toner off the photoconductive drum 51 when the toner-transferring process is skipped for having all the toner supplied to the photoconductive drum remain. The item "Independent Charging Capability" is for making an assessment of the capability of charging the photoconductive drum by the charging unit 61 for the conventional image forming apparatus, and the capability of charging the photoconductive drum 51 by the cleaning unit 1 alone for the first embodiment. The item "Rubber Durability" is for making an assessment of the degradation of the cleaning blade 3 such as wear, chip, or settling.

TABLE 1

| Item | Conventional Image Forming Apparatus | Embodiment 1 |
|---|---|---|
| Cleaning Capability | ⊙ (excellent) | ○ (satisfying) |

TABLE 1-continued

| Item | Conventional Image Forming Apparatus | Embodiment 1 |
|---|---|---|
| Independent Charging Capability | ⊙ (stable) | ○ (good though not uniform) |
| Rubber Durability (chipping off etc.) | ○ (good) | Δ (acceptable) |
| Resistivity to OPC Cyclic Incidental Image | x (no good) | ⊙ (excellent) |

As seen from Table 1, the first embodiment is somewhat inferior to the conventional image forming apparatus in the cleaning capability and the rubber durability, since the cleaning blade 3 of the cleaning unit 1 of the first embodiment is made of semiconductive urethane rubber, though the first embodiment is at an acceptable in these items. In the case of having the cleaning unit 1 perform electrification alone, slight unevenness occurs in a formed image after repetition of image forming cycles. However, it has been confirmed that in the case of having the cleaning unit 1 and the charging unit 61 perform electrification jointly, such uneveness becomes imperceptible, and the OPC cyclic incidental image does not occur as well.

Also, it has been confirmed through experiment that when the resistivity of the semiconductive urethane rubber is between 106 Ωcm–1010 Ωcm, electrification is performed uniformly, when the resistivity of the semiconductive urethane rubber is smaller than 106 Ωcm, nonuniformity arises in the electrification, and when the resistivity of the semiconductive urethane rubber exceeds 1010 Ωcm, the surface potential does not rise to the desired value and therefore the OPC cyclic incidental image does not disappear.

As described above, according to the first embodiment, since the cleaning unit 1 precharges the periphery 51*a* of the photoconductive drum 51 whose potential has been lowered to nearly 0 V after an overall exposure to an appropriate level while preserving its cleaning ability, it is possible to charge the periphery 51*a* of the photoconductive drum 51 to a desired potential by the charging unit 61 at once.

Thus, a high quality image free from the OPC cyclic incidental image can be obtained.

In the first embodiment, although carbon is added to the urethane rubber to provide the urethane rubber with conductivity, metal oxide, conductive filler, ions, or a mixture of them may be added instead. For the material of the cleaning blade 3, urethane rubber is used in the first embodiment, the present invention is not limited thereto, and different kinds of rubber may be used.

Furthermore, the first embodiment has the photoconductive drum 51 as an image carrier, it is needless to say that the present invention is applicable to any image forming apparatus that forms electrostatic latent image.

A Second Embodiment

Figure 2:
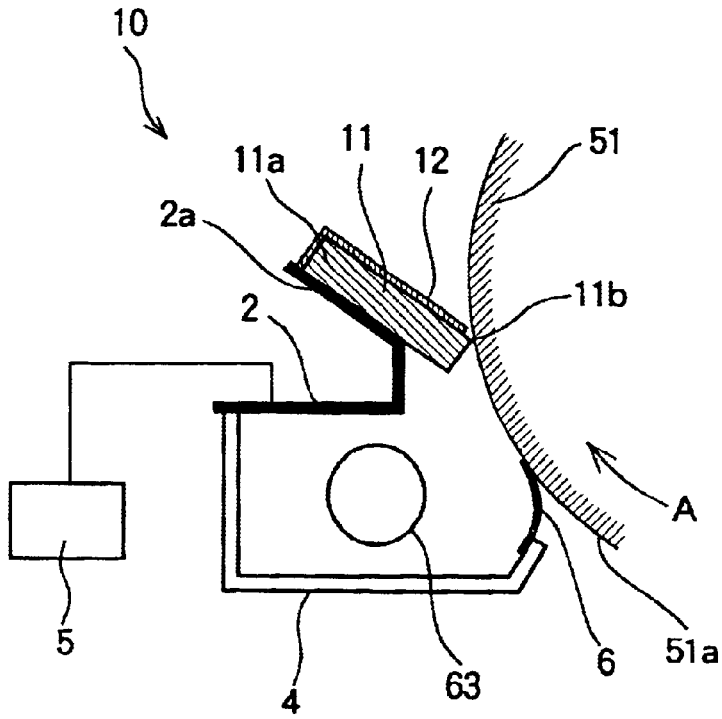
FIG. 2(*a*) is a section view schematically showing a structure of a cleaning unit for use in an image forming apparatus of a second embodiment according to the invention.
Figure 2:
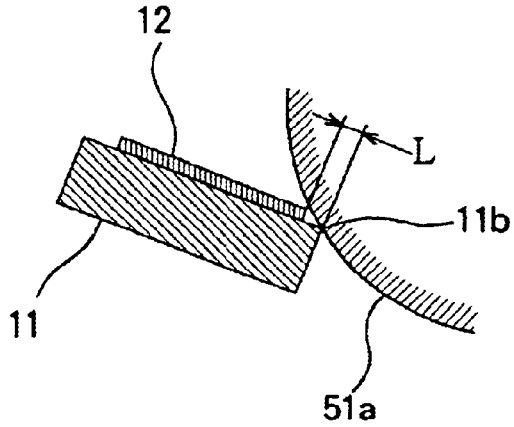

FIG. 2(*a*) is a section view schematically showing a structure of a cleaning unit 10 for use in an image forming apparatus of a second embodiment according to the invention.

This cleaning unit 10 can replace the cleaning unit 59 of the image forming apparatus 50 described above with reference to FIG. 9 without any change in other units and elements of the image forming apparatus 50. This cleaning unit 10 differs from the cleaning unit 1 of the first embodiment in that the material of the cleaning blade 11 of the cleaning unit 10 is different from that of the cleaning unit 1, and the cleaning unit 10 is additionally provided with a semiconductive resin tape 12.

Accordingly, the cleaning unit 10 will be described supposing that it is disposed in the image forming apparatus 50 shown in FIG. 9, and detailed explanation of each of the parts of the image forming apparatus 50 will be omitted except the cleaning unit 10 and other parts common to the cleaning unit 1 of the first embodiment in the interest of simplicity.

In FIG. 2, to the incline 2*a* of the metal holder 2 fixed is the edge 11*a* of a cleaning blade 11 having a thickness of 1 mm to 3 mm made of semiconductive urethane rubber that extends substantially for the whole width of the photoconductive drum 51. The other edge 11*b* presses the periphery 51*a* of the photoconductive drum 51.

The semiconductive resin tape 12 is stuck on the surface of the cleaning blade 11 as a precharging device so as to extend from the metal holder 2 to the edge 11*b* of the cleaning blade 11. The semiconductive resin tape 12 is preferably made of a material having resistivity of 106 Ωcm–1010 Ωcm such as nylon resin, urethane resin, or fluorine resin. The metal holder 2 and the semiconductive resin tape 12 are therefore in an electrically interconnected state.

FIG. 2(*b*) is a partially enlarged view of the edge 11*b* of the cleaning blade 11 and the parts adjoining thereto. The distance L between the edge 11*b* of the cleaning blade 11 and the front edge of the semiconductive resin tape 12 is preferably shorter than 1 mm. If the distance L is too long, electrification becomes impossible.

The operation of the image forming apparatus of the second embodiment having the above-described structure will be explained.

The toner that has adhered to the periphery 51*a* of the photoconductive drum 51 is scraped by the edge 11*b* of the cleaning blade 11 and falls into the toner receiver 4 when it reaches the contact point where the periphery 51*a* of the photoconductive drum 51 and the edge 11*b* of the cleaning blade 11 press each other. The waste toner accumulated within the toner receiver 4 is carried in a certain direction by the toner spiral 63 rotating inside the toner receiver 4 and discharged from the toner receiver 4.

On the other hand, in the vicinity of the contact point between the periphery 51*a* of the photoconductive drum 51 and the edge 11*b* of the cleaning blade 11, the semiconductive resin tape 12 applied with the voltage supplied from the dedicated power supply 5 precharges the periphery 51*a* of the photoconductive drum 51 in a non-contact manner. At this time, it is preferable that the above-described expression (1) is satisfied for the previously described reason.

Table 2 shows performances of the conventional image forming apparatus shown in FIG. 9, the image forming apparatus of the previously described first embodiment, and the image forming apparatus of the second embodiment in each of the items explained below.

The items include "Resistivity to Damage to Photoconductive Drum" in addition to "Cleaning Capability", "Independent Charging Capability", "Rubber Durability, and "Resistivity to OPC Cyclic Incidental Image" explained in the foregoing first embodiment.

TABLE 2

| Item | Conventional Image Forming Apparatus | Embodiment 1 | Embodiment 2 |
|---|---|---|---|
| Cleaning Capability | ⊙ (excellent) | ○ (satisfying) | ⊙ (as excellent as previously) |

TABLE 2-continued

| Item | Conventional Image Forming Apparatus | Embodiment 1 | Embodiment 2 |
|---|---|---|---|
| Independent Charging Capability | ⊙ (stable) | ○ (good though not uniform) | ○ (good though not uniform) |
| Rubber Durability (chipping off etc.) | ○ (good) | Δ (acceptable) | ○ (as good as previously) |
| Resistivity to OPC Cyclic Incidental Image | x (no good) | ⊙ (excellent) | ⊙ (excellent) |
| Resistivity to Damage to Photoconductive Drum | ○ (good) | ○ (good) | Δ (acceptable) |

As seen from Table 2, the second embodiment having the cleaning unit 10 shows as good performances in the cleaning capability and the rubber durability as the first embodiment since the cleaning blade 11 is made of urethane rubber as previously. Although toner adhesion and streaks of nonuniformity due to scratches caused by friction occur slightly to the periphery of the photoconductive drum 51 after repetition of image forming cycles in the case of having the cleaning unit 10 perform electrification alone, it has been confirmed that a formed image is at a satisfying level and no OPC cyclic incidental image occurs in the case of having the cleaning unit 10 and the charging unit 61 perform electrification jointly.

As described above, the second embodiment has, not only the same advantage as the first embodiment, the different advantage that the cleaning unit 10 thereof shows good performance in the cleaning capability and the rubber durability since it is made of the same material as the conventional cleaning unit, thereby allowing a good and stable cleaning performance over a long period of time.

Although the second embodiment uses the semiconductive resin tape 12, any appropriate tape coated with a semiconductive resin film maybe used. If such a tape is coated with nylon resin, urethane resin, or fluororesin which is used as a material of a charging roller because of their resistivity to the toner adhesion and good addhesiveness with the urethane rubber which is used as the material of the cleaning blade 11, the cleaning unit 19 can perform stable electrification over a long period of time.

A Third Embodiment.

Figure 3:
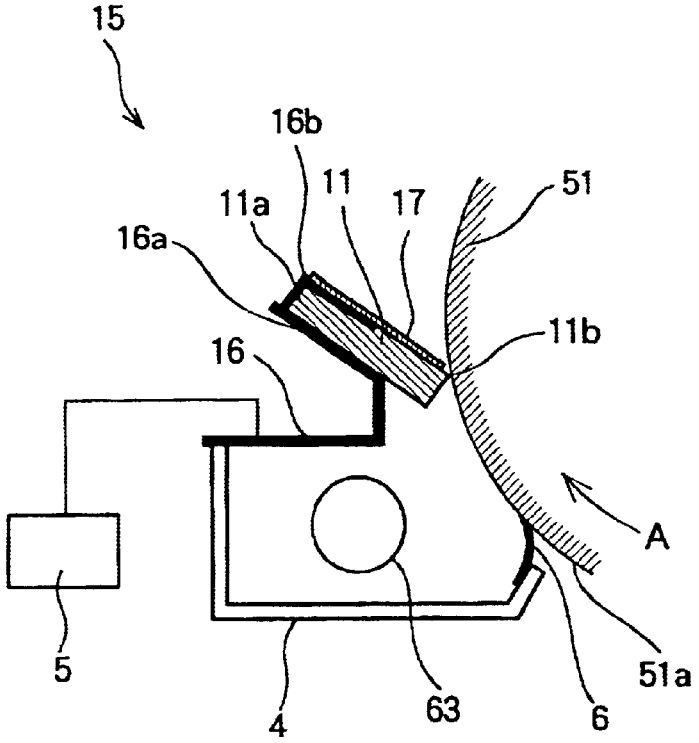
FIG. 3 is a section view schematically showing a structure of a cleaning unit for use in an image forming apparatus of a third embodiment according to the invention.

FIG. 3 is a section view schematically showing a structure of a cleaning unit 15 for use in an image forming apparatus of a third embodiment according to the invention.

This cleaning unit 15 can replace the cleaning unit 59 in the image forming apparatus 50 described above with reference to FIG. 9 as is the case with the cleaning unit 1 of the first embodiment without any change in other units and elements of the image forming apparatus 50. This cleaning unit 15 differs from the cleaning unit 10 of the second embodiment in that the shape of the metal holder 16 is different from that of the metal holder 2, and a semiconductive rubber layer 17 is used in place of the semiconductive resin tape 12.

Accordingly, the cleaning unit 15 will be described supposing that it is disposed in the image forming apparatus 50 shown in FIG. 9, and detailed explanation of each of the parts of the image forming apparatus 50 will be omitted except the cleaning unit 15 and other parts common to the cleaning unit 10 of the second embodiment in the interest of simplicity.

In FIG. 3, to an incline 16*a* of the metal holder 16 fixed is the edge 11*a* of the cleaning blade 11 having a thickness of 1 mm to 3 mm made of semiconductive urethane rubber that extends substantially for the whole width of the photoconductive drum 51. The other edge 11*b* presses the periphery 51*a* of the photoconductive drum 51. The metal holder 16 is provided with an L-shape holding member 16*b* extending from the incline 16*a* for fixing the cleaning blade 11 therein. The cleaning blade 11 is held within the L-shape holding member 16*b* in a slightly compressed state.

The semiconductive rubber layer 17 made of the same material (for example, rubber made of silicon polymer containing carbon as an additive to achieve conductivity) as the elastic layer of the charging roller 52 (FIG. 9) is stuck as a precharging device on the surface of the L-shape holding member 16*b* and the surface of the cleaning blade 11 which are flush with each other. The resistivity of this semiconductive rubber layer 17 is preferably between 106 Ωcm–1010 Ωcm so that the metal holder 16 and the semiconductive rubber layer 17 are in an electrically interconnected state.

The rubber layer 17 is disposed such that the tip thereof is slightly behind the edge 11*b* of the cleaning blade 11 keeping a certain distance appropriate for non-contact electrification from the periphery 51*a* of the photoconductive drum 51.

The operation of the third embodiment having the above structure will be explained.

The toner that has adhered to the periphery 51*a* of the photoconductive drum 51 is scraped by the edge 11*b* of the cleaning blade 11 and falls into the toner receiver 4 when it reaches the contact point where the periphery 51*a* of the photoconductive drum 51 and the edge 11*b* of the cleaning blade 11 press each other. The waste toner accumulated within the toner receiver 4 is carried in a certain direction by the toner carrying spiral 63 rotating inside the toner receiver 4 and discharged from the toner receiver 4.

On the other hand, in the vicinity of the contact point between the periphery 51*a* of the photoconductive drum 51 and the edge 11*b* of the cleaning blade 11, the semiconductive rubber layer 17 applied with the voltage supplied from the dedicated power supply 5 precharges the periphery 51*a* of the photoconductive drum 51 in a non-contact manner. At this time, it is preferable that the above-described expression (1) is satisfied for the previously described reason.

If any resin layer or surface modification layer is provided on the surface of the elastic rubber layer of the charging roller 52 (FIG. 9), it is preferable that a similar resin layer or a similar surface modification layer is provided on the surface of the rubber layer 17.

Table 3 shows performances of the image forming apparatus of the foregoing first and second embodiments, and the image forming apparatus of this third embodiment in each of the items explained below.

The items include "Cleaning Capability", "Independent Charging Capability", "Rubber Durability, "Resistivity to OPC Cyclic Incidental Image", and "Resistivity to Damage to Photoconductive Drum " as in the case of the second embodiment.

TABLE 3

| Item | Embodiment 1 | Embodiment 2 | Embodiment 3 |
|---|---|---|---|
| Cleaning Capability | ○ (satisfying) | ⊙ (as excellent as previously) | ⊙ (as excellent as previously) |

TABLE 3-continued

| Item | Embodiment 1 | Embodiment 2 | Embodiment 3 |
|---|---|---|---|
| Independent Charging Capability | ○ (good though not uniform) | ○ (good though not uniform) | ⊙ (excellent) |
| Rubber Durability (chipping off etc.) | Δ (acceptable) | ○ (as good as previously) | ○ (as good as previously) |
| Resistivity to OPC Cyclic Incidental Image | ⊙ (excellent) | ⊙ (excellent) | ⊙ (excellent) |
| Resistivity to Damage to Photoconductive Drum | ○ (as good as previously) | Δ (acceptable) | ○ (as good as previously) |

As seen from Table 3, the third embodiment having the cleaning unit 15 shows as good performances in the cleaning capability and the rubber durability as the second embodiment since the cleaning blade 11 is made of urethane rubber as previously. In addition, it has been confirmed that a high quality image with very little nonuniformity can be formed even when electrification is performed by the cleaning unit 15 alone, since the photoconductive drum 51 is charged by the semiconductive rubber layer 17 made of the same material as the charging roller 52 and having the same resistance as the charging roller 52.

As described above, the third embodiment has, in addition to the same advantage as the second embodiment, the different advantage that the probability of damaging the periphery 51*a* of the photoconductive drum 51 is less since the rubber layer 17 that performs electrification is resistant to toner adhesion, allowing stable electrification over a long period of time.

A fourth embodiment

Figure 4:
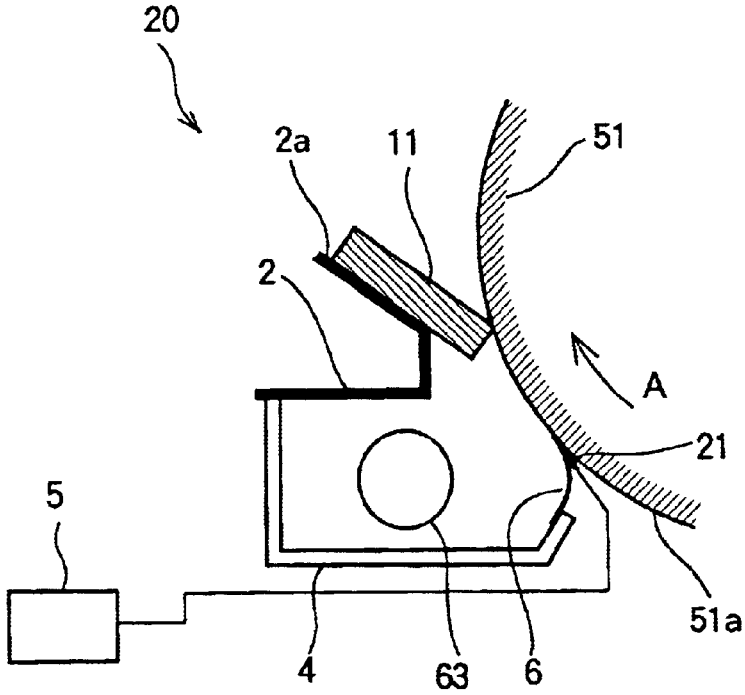
FIG. 4(*a*) is a section view schematically showing a structure of a cleaning unit for use in an image forming apparatus of a fourth embodiment according to the invention.
Figure 4:
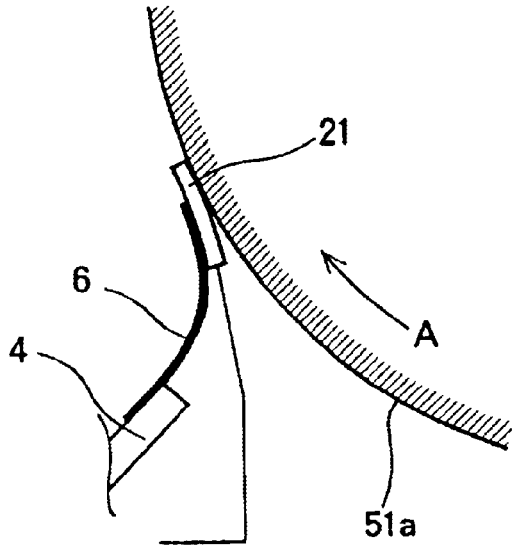

FIG. 4(*a*) is a section view schematically showing a structure of a cleaning unit 20 for use in an image forming apparatus of a fourth embodiment according to the invention.

This cleaning unit 20 can replace the cleaning unit 59 in the image forming apparatus 50 described above with reference to FIG. 9 as is the case with the cleaning unit 1 of the first embodiment without any change in other units and elements. This cleaning unit 20 differs from the cleaning unit 1 of the first embodiment in that the material of the cleaning blade 11 of the cleaning unit 20 is different from that of the cleaning unit 1, and the cleaning unit 20 is additionally provided with a semiconductive resin tape 21.

Accordingly, the cleaning unit 20 will be described supposing that it is disposed in the image forming apparatus 50 shown in FIG. 9, and detailed explanation of each of the parts of the image forming apparatus 50 will be omitted except the cleaning unit 20 and other parts common to the cleaning unit 1 of the first embodiment in the interest of simplicity.

The cleaning blade 11 of this embodiment is made of insulative urethane rubber having a thickness of 1 mm to 3 mm as in the case of the second embodiment.

FIG. 4(*b*) is a partially enlarged view showing the toner-leakage preventing film 6 and the parts adjoining thereto. As shown in FIG. 4(*b*), the semiconductive resin tape 21 serving as a precharging device is stuck to the tip of the toner-leakage preventing film 6 so as to make contact with the periphery 51*a* of the photoconductive drum 51. This semiconductive resin tape 21 is applied with the d.c. (or a.c+d.c.) voltage by the dedicated power supply 5.

The operation of the fourth embodiment having the above structure will be explained.

The toner that has adhered to the periphery 51*a* of the photoconductive drum 51 is scraped by the edge 11*b* of the cleaning blade 11 and falls into the toner receiver 4 when it reaches the contact point where the periphery 51*a* of the photoconductive drum 51 and the edge 11*b* of the cleaning blade 11 press each other. The waste toner accumulated within the toner receiver 4 is carried in a certain direction by the toner spiral 63 rotating inside the toner receiver 4 and discharged from the toner receiver 4.

The semiconductive resin tape 21 upstream from the cleaning blade 11 negatively charges the periphery 51*a* of the photoconductive drum 51. At this time, it is preferable that the above-described expression (1) is satisfied for the previously described reason. In this fourth embodiment, the periphery 51*a* of the photoconductive drum 51 is negatively charged before it is cleaned by the toner-scraping operation of the cleaning blade 11 so that the residual negatively charged toner (most of the residual toner except fog toner is negatively charged) can be easily removed from the periphery 51*a* of the photoconductive drum 51 by electrostatic repulsion.

Figure 5:
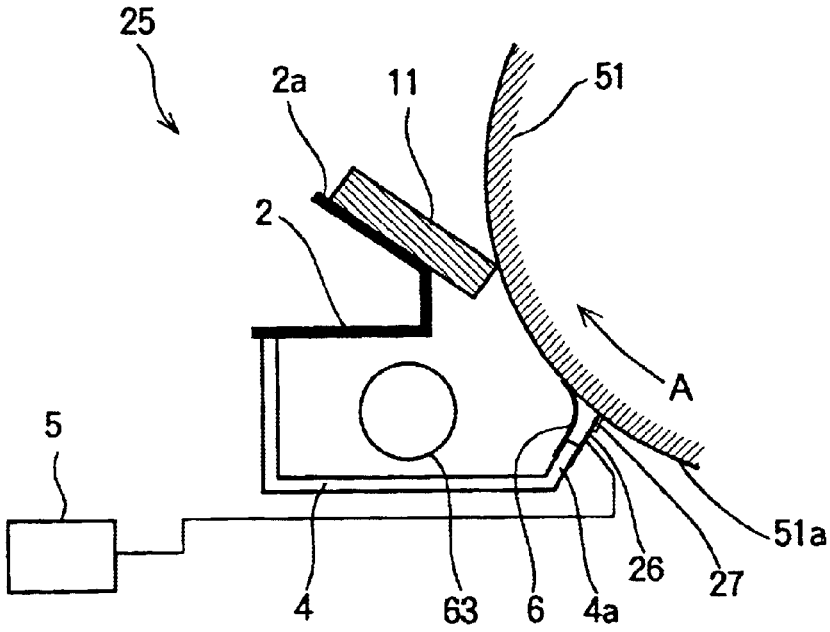
FIG. 5(*a*) is a section view schematically showing a structure of a cleaning unit for use in a variant of the fourth embodiment.
Figure 5:
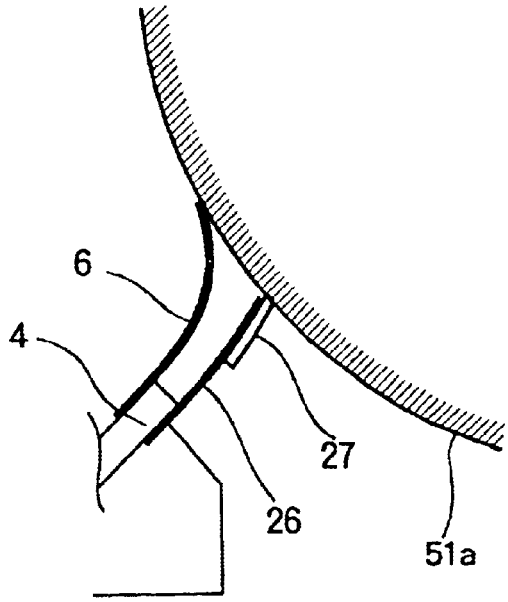

FIG. 5(*a*) is a section view schematically showing a structure of a cleaning unit 25 for use in a variant of the fourth embodiment according to the invention. In this variant, a semiconductive resin tape 27 is stuck as a precharging device to the tip of a diselectrification plate 26 provided as necessary at the bottom 4*a* of the toner receiver 4. This diselectrification plate 26 is applied with the d.c. (or a.c+d.c.) voltage by the dedicated power supply 5, and the semiconductive resin tape 27 is applied with the same voltage.

The cleaning operation and the electrification operation of the cleaning unit 25 are much the same as those of the cleaning unit 20 shown in FIG. 4, explanation thereof will be omitted.

Table 4 shows performances of the image forming apparatus of the foregoing first, second and third embodiments, and the image forming apparatus of this fourth embodiment in each of the items explained below.

The items include "Resistivity to Drum-Filming" in addition to "Cleaning Capability", "Independent Charging Capability", "Rubber Durability", "Resistivity to OPC Cyclic Incidental Image", and "Resistivity to Damage to Photoconductive drum " explained in the foregoing third embodiment.

TABLE 4

| Item | Embodiment 1 | Embodiment 2 | Embodiment 3 | Embodiment 4 |
|---|---|---|---|---|
| Cleaning Capability | ○ (satisfying) | ⊙ (as excellent as previously) | ⊙ (as excellent as previously) | ⊙ (as excellent as previously) |
| Independent Charging Capability | ○ (good though not uniform) | ○ (good though not uniform) | ⊙ (excellent) | Δ (acceptable) |
| Rubber Durability (chipping off etc.) | Δ (acceptable) | ○ (as good as previously) | ○ (as good as previously) | ○ (as good as previously) |
| Resistivity to OPC Cyclic Incidental Image | ⊙ (excellent) | ⊙ (excellent) | ⊙ (excellent) | ⊙ (excellent) |

TABLE 4-continued

| Item | Embodiment 1 | Embodiment 2 | Embodiment 3 | Embodiment 4 |
|---|---|---|---|---|
| Resistivity to Damage to Photo-conductive Drum | ○ (as good as previously) | Δ (acceptable) | ○ (as good as previously) | Δ (acceptable) |
| Resistivity to Drum-Filming | ○ (good) | ○ (good) | ○ (good) | ◎ (excellent) |

As seen from Table 4, it has been confirmed that the OPC cyclic incidental image does not occur in the fourth embodiment having the cleaning unit 20 or 25 as is the case with the preceding embodiments. In addition, this fourth embodiment is superior to other embodiments in resistivity to the occurrence of the drum-filming phenomena because of the improvement in the cleaning capability. The item "Resistivity to drum-cleaning capability" is for making an assessment of the capability of preventing the drum-filming phenomena that may occur on the periphery 51*a* of the photoconductive drum 51 after repetitions of image forming cycles.

As described above, the fourth embodiment has, in addition to the same advantage as the second embodiment, the different advantage that the toner-scraping capability of the cleaning blade 11 is improved since the periphery 51*a* of the photoconductive drum 51 is charged upstream from the cleaning blade 11, and accordingly the drum-filming phenomenon can be avoided, thereby enabling forming high quality images for a long period of time.

A Fifth Embodiment

Figure 6:
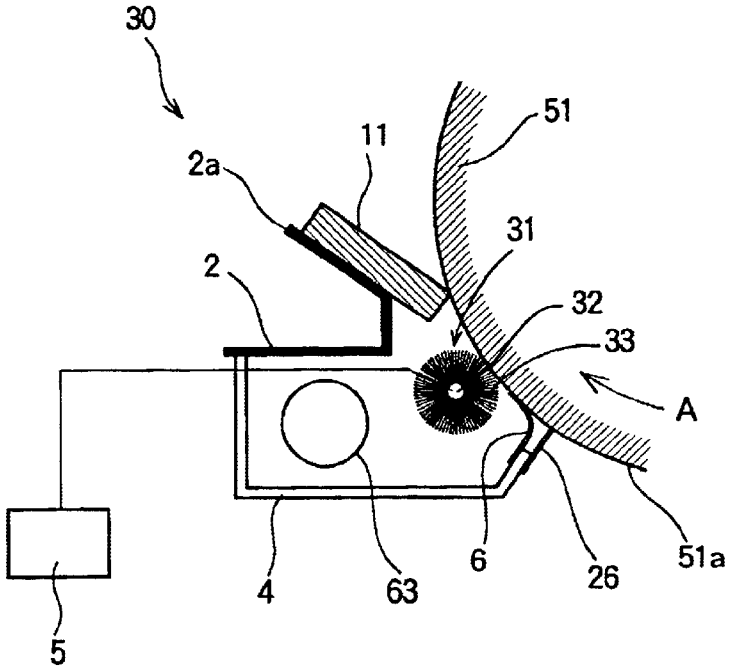
FIG. 6 is a section view schematically showing a structure of a cleaning unit for use in an image forming apparatus of a fifth embodiment according to the invention.

FIG. 6 is a section view schematically showing a structure of a cleaning unit 30 for use in an image forming apparatus of a fifth embodiment according to the invention.

This cleaning unit 30 can replace the cleaning unit 59 in the image forming apparatus 50 described above with reference to FIG. 9 as is the case with the cleaning unit 1 of the first embodiment without any change in other units and elements. This cleaning unit 30 differs from the cleaning unit 1 of the first embodiment in that the material of the cleaning blade 11 of the cleaning unit 30 is different from that of the cleaning unit 1, and the cleaning unit 30 is additionally provided with a brush roller 31.

Accordingly, the cleaning unit 30 will be described supposing that it is disposed in the image forming apparatus 50 shown in FIG. 9, and detailed explanation of each of the parts of the image forming apparatus 50 will be omitted except the cleaning unit 30 and other parts common to the cleaning unit 1 of the first embodiment in the interest of simplicity.

The cleaning blade 11 of this embodiment is made of insulative urethane rubber having a thickness of 1 mm to 3 mm as in the case of the cleaning unit 10 shown in FIG. 2 of the second embodiment.

The brush roller 31 serving as the precharging device is comprised of a metal shaft 32 disposed within the toner receiver 4 so as to extend in parallel with the rotation axis of the photoconductive drum 51 in the vicinity of the photoconductive drum 51 and semiconductive fibers 33 made of nylon provided so as to extend radially from the metal shaft 32. The metal shaft 32 is set in such a position that the tips of the semiconductive fibers 33 contact with and slide on the periphery 51*a* of the photoconductive drum 51.

The metal shaft 32 is driven by a not-illustrated driving unit to have a peripheral speed different from that of the photoconductive drum 51 so that the tips of the semiconductive fibers 33 brush the periphery 51*a* of the photoconductive drum 51. The metal shaft 32 is also applied with the d.c. (or a.c+d.c.) voltage by the dedicate power supply 5.

The operation of the fifth embodiment having the above structure will be explained.

The toner and toner additive that have adhered to the periphery 51*a* of the photoconductive drum 51 are scraped therefrom preparatively by the brush roller 31 before they are scraped by the cleaning blade 11. Concurrently, the periphery 51*a* of the photoconductive drum 51 is precharged in a contact manner by the brush roller 31 applied with the voltage by the dedicated power supply 5. At this time, it is preferable that the above-described expression (1) is satisfied for the previously described reason.

Table 5 shows performances of the image forming apparatus of the foregoing second, third and fourth embodiments, and the image forming apparatus of this fourth embodiment in each of the items explained below.

The items include "Resistivity to Contamination of the Charging Roller" in addition to "Cleaning Capability", "Independent Charging Capability", "Rubber Durability", "Resistivity to OPC Cyclic Incidental Image", "Resistivity to Damage to Photoconductive Drum ", and "Resistivity to Drum-Filming" explained in the foregoing third embodiment.

TABLE 5

| Item | Embodiment 2 | Embodiment 3 | Embodiment 4 | Embodiment 5 |
|---|---|---|---|---|
| Cleaning Capability | ◎ (as excellent as previously) | ◎ (as excellent as previously) | ◎ (as excellent as previously) | ◎ (as excellent as previously) |
| Independent Charging Capability | ○ (good though not uniform) | ◎ (excellent) | Δ (acceptable) | Δ (acceptable) |
| Rubber Durability (chipping off etc.) | ○ (as good as previously) | ○ (as good as previously) | ○ (as good as previously) | ○ (as good as previously) |
| Resistivity to OPC Cyclic Incidental Image | ◎ (excellent) | ◎ (excellent) | ◎ (excellent) | ◎ (excellent) |
| Resistivity to Damage to Photo-conductive Drum | Δ (acceptable) | ○ (as good as previously) | Δ (acceptable) | ○ (as good as previously) |
| Resistivity to Drum-Filming | ○ (good) | ○ (good) | ◎ (excellent) | ◎ (excellent) |
| Resistivity to Contamination of the Charging Roller | Δ (acceptable) | ○ (good) | ○ (good) | ◎ (excellent) |

As seen from Table 5, the fifth embodiment having the cleaning unit 30 is superior in points of the cleaning capability and the resistivity to the drum-filming since the periphery 51*a* of the photoconductive drum 51 is charged upstream from the cleaning blade 11 as is the case with the fourth embodiment having the cleaning unit 25. Furthermore, since the brush roller 31 brushes the periphery 51*a* of the photoconductive drum 51 with its relatively soft semiconductive fibers 33, the photoconductive drum 51 suffers less damage compared with the fourth embodiment. In the fifth embodiment, since the brush roller 31 is applied with a high negative voltage, the external toner additive is kept within the brush roller 31 by electrostatic suction power.

In addition, since it is possible to negatively charge the external toner additive as a result of improvement in capability of frictional electrification owing to the rotation of the brush roller 31 and the voltage application to the brush roller 31, and it is possible to negatively charge the photoconductive drum 51 upstream from the cleaning blade 11, the fifth embodiment has excellent toner and external toner additive removing capability as in the case of the fourth embodiment. Accordingly, the quantity of the external additive that is not scraped down by the cleaning blade 11 but passes the cleaning blade 11 can be reduced.

Furthermore, since the quantity of the external additive adhering to the charging roller 52 (FIG. 9) is small by virtue of the cleaning blade 30, the fifth embodiment can avoid the contamination of the charging roller 52 with a large quantity of the external additive that can form an insulation film that brings about poor electrification.

The contamination of the charging roller 52 can be detected quantitatively from the quantity of the external additive caught in the charging roller 52. Accordingly, the assessment on the item "contamination of the charging roller 52" in Table 5 is based on the quantity of the external additive adhered to the charging roller 52. It has been confirmed that the quantity of the external additive caught in the charging roller 52 of the fifth embodiment is far smaller than that of any other foregoing embodiments.

As described above, the fifth embodiment provided with the cleaning blade 30 has, in addition to the same advantages as those of the fourth embodiment, the different advantages that occurrence of the drum-filming phenomena can be avoided since the photoconductive drum 51 is charged to the desired potential by the brush roller 31 upstream from the cleaning blade 11 and the contamination of the charging roller 52 with a large quantity of the external additive passing through the cleaning blade 11 can be avoided. Accordingly, with the fifth embodiment, it is possible to form high quality images stably for a long period of time.

A Sixth Embodiment

Figure 7:
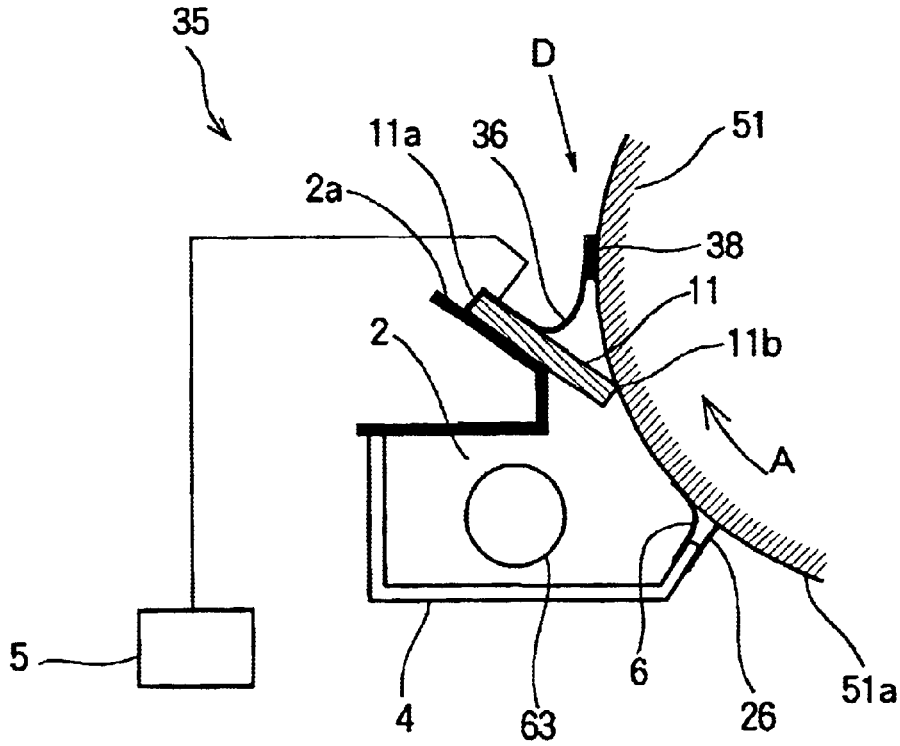
FIG. 7(*a*) is a section view schematically showing a structure of a cleaning unit for use in an image forming apparatus of a sixth embodiment according to the invention.
Figure 7:
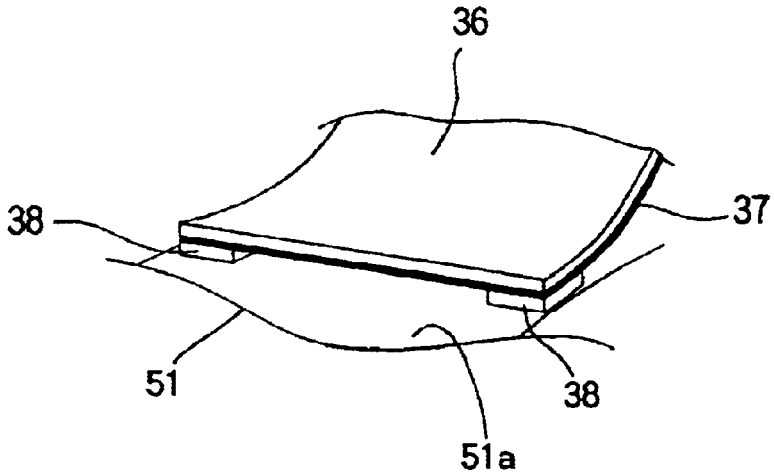

FIG. 7(*a*) is a section view schematically showing a structure of a cleaning unit 35 for use in a sixth embodiment according to the invention, and FIG. 7(*b*) is a partially enlarged perspective view of a metal plate 36 when viewed in the direction of the arrow D shown in FIG. 7(*a*) trending from the reverse side to the obverse side of the drawing sheet.

This cleaning unit 35 can replace the cleaning unit 59 in the image forming apparatus 50 described above with reference to FIG. 9 as is the case with the cleaning unit 1 of the first embodiment without any change in other units and elements. This cleaning unit 35 differs from the cleaning unit 1 of the first embodiment in that the material of the cleaning blade 11 of the cleaning unit 35 is different from that of the cleaning unit 1, and the metal plate 36 and some incidental members are additionally provided.

Accordingly, the cleaning unit 35 will be described supposing that it is disposed in the image forming apparatus 50 shown in FIG. 9, and detailed explanation of each of the parts of the image forming apparatus 50 will be omitted except the cleaning unit 35 and other parts common to the cleaning unit 1 of the first embodiment in the interest of simplicity.

The cleaning blade 11 of this embodiment is made of insulative urethane rubber having a thickness of 1 mm to 3 mm as in the case of the cleaning unit 10 shown in FIG. 2 of the second embodiment.

As shown in FIG. 7(*a*), the metal plate 36 that is resilient and is 0.05 mm to 0.5 mm in thickness is provided on the obverse side (the surface not in contact with the metal holder 2) of the cleaning blade 11. The metal plate 36 is fixed to one end portion 11*a* of the cleaning blade 11 keeping a curved state so that its surface in contact with the cleaning blade 11 (referred to as a contact surface hereinafter) faces the periphery 51*a* of the photoconductive drum 51. As shown in FIG. 7(*b*), a semiconductive resin coat layer 37 having resistivity of 106 Ωcm–1010 Ωcm is provided on the contact surface of the metal plate 36 as a precharging device. Insulation films 38 having thickness between 20 μm–70 μm, preferably 50 μm are stuck to both corners of the end of the semiconductive resin coat layer 37 in order to leave a clearance of about 20 μm–70 μm between the semiconductive resin coat layer 37 and the periphery 51*a* of the photoconductive drum 51. It has been confirmed through experiment that the periphery 51*a* of the photoconductive drum 51 and the semiconductive resin coat layer 37 can stably keep a non-contact state with each other when 50 μm of clearance is left between them.

Accordingly, the semiconductive resin coat layer 37 urged towards the periphery 51*a* of the photoconductive drum 51 by the metal plate 36 can keep a distance between 20 μm–70 μm from the periphery 51*a* of the photoconductive drum 51 by use of the insulation films 38 having a thickness of about 50 μm. This semiconductive resin coat layer 37 is applied with a d.c. (or a.c+d.c.) voltage thorugh the metal plate 36 by the dedicated power supply 5.

The operation of the sixth embodiment having the above structure will be explained.

The toner that has adhered to the periphery 51*a* of the photoconductive drum 51 is scraped by the cleaning blade 11 as is the case with the foregoing embodiments. In this embodiment, the semiconductive resin coat layer 37 charges the periphery 51*a* of the photoconductive drum 51 in a non-contact manner. At this time, it is preferable that the above-described expression (1) is satisfied for the previously described reason.

According to the sixth embodiment, since a certain clearance is kept between the periphery 51*a* of the photoconductive drum 51 and the semiconductive resin coat layer 37, and accordingly the semiconductive resin coat layer 37 is not broken by the toner that has adhered to the photoconductive drum 51, the occurrence of non-uniform electrification and scratches on the periphery 51*a* of the photoconductive drum 51 can be avoided.

In this sixth embodiment, since the cleaning unit 35 performs electrification in a non-contact manner, it is desirable that the dedicated power supply 5 generates the (a.c+d.c.) voltage higher than the voltage to be generated in the case of performing electrification in a contact manner.

Table 6 shows performances of the image forming apparatus of the foregoing second, fourth and fifth embodiments, and the image forming apparatus of this sixth embodiment in each of the items explained below.

The items include "Cleaning Capability", "Independent Charging Capability", "Rubber Durability", "Resistivity to OPC Cyclic Incidental Image", "Resistivity to Damage to Photoconductive Drum", "Resistivity to Drum-Filming", and "Resistivity to Contamination of the Charging Roller" as in the case of the fifth embodiment.

TABLE 6

| Item | Embodiment 2 | Embodiment 4 | Embodiment 5 | Embodiment 6 |
|---|---|---|---|---|
| Cleaning Capability | ⊙ (as excellent as previously) | ⊙ (as excellent as previously) | ⊙ (as excellent as previously) | ⊙ (excellent) |

TABLE 6-continued

| Item | Embodiment 2 | Embodiment 4 | Embodiment 5 | Embodiment 6 |
|---|---|---|---|---|
| Independent Charging Capability | ○ (good though not uniform) | Δ (acceptable) | Δ (acceptable) | ◎ (excellent) |
| Rubber Durability (chipping off etc.) | ○ (as good as previously) | ○ (as good as previously) | ○ (as good as previously) | ○ (good) |
| Resistivity to OPC Cyclic Incidental Image | ◎ (excellent) | ◎ (excellent) | ◎ (excellent) | ◎ (excellent) |
| Resistivity to Damage to Photo-conductive Drum | Δ (acceptable) | Δ (acceptable) | ○ (as good as previously) | ○ (excellent) |
| Resistivity to Drum-Filming | ○ (good) | ◎ (excellent) | ◎ (excellent) | ○ (good) |
| Resistivity to Contamination of the Charging Roller | Δ (acceptable) | ○ (good) | ◎ (excellent) | Δ (acceptable) |

As seen from Table 6, it has been confirmed that the damage to the photoconductive drum 51 in the sixth embodiment having the cleaning unit 35 is small compared to other embodiments.

As described above, the sixth embodiment has, in addition to the same advantages as those of the second embodiment, the different advantage that the photoconductive drum 51 is not damaged, since the non-contact state between the periphery 51*a* of the photoconductive drum 51 and the semiconductive resin coat layer 37 is secured, whereby the photoconductive drum 51 is not damaged and accordingly high quality images can be formed over a long period of time. Furthermore, since the preliminary electrification is performed downstream from the cleaning unit 35, the precharging device 36 resists being contaminated by the toner, so that the preliminary electrification can be performed stably.

Although the semiconductive resin coat layer 37 is provided on the contact surface of the metal plate 36 in the sixth embodiment, it is permissible to use any appropriate semiconductive tape instead of the semiconductive resin coat layer 37.

The above explained preferred embodiments are exemplary of the invention of the present application which is described solely by the claims appended below. It should be understood that modifications of the preferred embodiments may be made as would occur to one of skill in the art.

What is claimed is:

1. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device; wherein (a) the precharging device contacts the surface of the image carrier, (b) an absolute value of a precharging potential applied by the precharging device to the image carrier is smaller than an absolute value of a charging potential applied by the charging unit to the image carrier, and (c) a polarity of the precharging potential applied by the precharging device to the image carrier is the same as the polarity of the charging potential applied by the charging unit to the image carrier.

2. An image forming apparatus according to claim 1, in which the precharging device includes a semiconductive member having resistivity between $10^6$ Ω cm and $10^{10}$ Ω cm.

3. An image forming apparatus according to claim 1, in which the precharging device has a cleaning capability of scraping residual toner off the surface of the image carrier.

4. An image forming apparatus according to claim 1, further comprising a cleaning unit disposed upstream from the charging unit with respect to the predetermined rotative direction of the image carrier for scraping residual toner off the surface of the image carrier, the precharging device being disposed upstream from the cleaning unit.

5. An image forming apparatus according to claim 4, further comprising a toner receiver for receiving toner scraped down by the cleaning unit, the precharging device comprising a semiconductive resin member supported by the toner receiver through an elastic member and applied with a predetermined voltage by the voltage supply unit.

6. An image forming apparatus according to claim 4, further comprising a toner receiver for receiving toner scraped down by the cleaning unit, the precharging device including a semiconductive resin member disposed within the toner receiver and applied with a predetermined voltage by the voltage supply unit.

7. An image forming apparatus according to claim 6, in which the precharging device comprises, as the semiconductive resin member, a brush roller applied with the predetermined voltage by the voltage supply unit, the brush roller including:

a rotatable conductive shaft extending substantially in parallel with a rotation axis of the image carrier, and a plurality of semiconductive fibers extending from the conductive shaft radially such that tips of the semiconductive fibers are capable of being in contact with the surface of the image carrier.

8. An image forming apparatus according to claim 1, further comprising a cleaning unit disposed upstream from the charging unit with respect to the predetermined rotative direction of the image carrier for scraping residual toner off the surface of the image carrier, the precharging device being disposed downstream from the cleaning unit.

9. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which an expression of $\{|V0|-|Va|\} \leqq 100$ V is satisfied, where V0 is a potential of the surface of the image carrier after the image carrier is charged by the charging unit and Va is a potential of the surface of the image carrier after the image carrier is precharged by the precharging device.

10. An image forming apparatus according to claim 9, in which an expression of $50\ V \leqq \{|V0|-|Va|\} \leqq 100$ V is satisfied, where V0 is a potential of the surface of the image carrier after the image carrier is charged by the charging unit and Va is a potential of the surface of the image carrier after the image carrier is precharged by the precharging device.

11. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which the precharging device has a cleaning capability of scraping residual toner off the surface of the image carrier;

in which the precharging device includes;

a conductive holder disposed in the vicinity of the surface of the image carrier, the conductive holder extending substantially in parallel with a rotation axis of the image carrier; and a cleaning blade made of semiconductive rubber and held in the conductive holder such that an end portion of the cleaning blade is in contact with the surface of the image carrier, the voltage supply unit applying the cleaning blade with a predetermined voltage.

12. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which the precharging device has a cleaning capability of scraping residual toner off the surface of the image carrier;

in which the precharging device includes;

a conductive holder disposed in the vicinity of the surface of the image carrier, the conductive holder extending substantially in parallel with a rotation axis of the image carrier;

a cleaning blade made of rubber and held in the conductive holder such that an end portion of the cleaning blade is in contact with the surface of the image carrier; and a semiconductive resin member provided on a surface of the cleaning blade so as to extend from the conductive holder to the end portion of the cleaning blade, the voltage supply unit applying the semiconductive resin member with a predetermined voltage.

13. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which the precharging device has a cleaning capability of scraping residual toner off the surface of the image carrier;

in which the precharging device includes:

a conductive holder disposed in the vicinity of the surface of the image carrier, the conductive holder extending substantially in parallel with a rotation axis of the image carrier;

a cleaning blade made of rubber and held in the conductive holder such that an end portion of the cleaning blade is in contact with the surface of the image carrier; and a semiconductive rubber layer formed on a surface of the cleaning blade so as to extend from the conductive holder to the end portion of the cleaning blade, the voltage supply unit applying the semiconductive rubber layer with a predetermined voltage.

14. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

further comprising a cleaning unit disposed upstream from the charging unit with respect to the predetermined rotative direction of the image carrier for scraping residual toner off the surface of the image carrier, the precharging device being disposed downstream from the cleaning unit;

in which the precharging device includes a semiconductive resin member supported by the cleaning unit through an elastic member and applied with a predetermined voltage by the voltage supply unit.

15. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which the precharging device includes a semiconductive member disposed in the vicinity of the image carrier so as to extend substantially in parallel with a rotation axis of the image carrier and oppose to the surface of the image carrier keeping a predetermined distance from the surface;

in which the predetermined distance is between 20 $\mu$m and 70 $\mu$m.

16. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device;

in which the precharging device includes a semiconductive member disposed in the vicinity of the image carrier so as to extend substantially in parallel with a rotation axis of the image carrier and oppose to the surface of the image carrier keeping a predetermined distance from the surface;

in which the semiconductive member of the precharging device is provided with a spacing member to be in contact with the surface of the image carrier at each of corners of an end portion of the semiconductive member in order to leave a clearance of the predetermined distance between the semiconductive member and the surface of the image carrier when the end portion of the semiconductive member is urged towards the surface of the image carrier;

in which the spacing member is an insulation film.

17. An image forming apparatus comprising:

an image carrier rotatable in a predetermined rotative direction;

a charging unit for charging a surface of the image carrier;

a precharging device disposed upstream from the charging unit with respect to the predetermined rotative direction of the image carrier for precharging the surface of the image carrier; and a voltage supply unit for supplying a voltage to the precharging device; wherein (b) an absolute value of a precharging potential applied by the precharging device to the image carrier is smaller than an absolute value of a charging potential applied by the charging unit to the image carrier, and (c) a polarity of the precharging potential applied by the precharging device to the image carrier is the same as the polarity of the charging potential applied by the charging unit to the image carrier, and (d) the precharging potential applied by the precharging device to the image carrier is substantially constant.

18. The image forming apparatus according to claim 17, wherein the precharging device is not in contact with the surface of the image carrier.

19. An image forming apparatus according to claim 18, in which the precharging device includes a semiconductive member disposed in the vicinity of the image carrier so as to extend substantially in parallel with a rotation axis of the image carrier and oppose to the surface of the image carrier keeping a predetermined distance from the surface.

20. An image forming apparatus according to claim 19, in which the semiconductive member comprises a semiconductive plate covered with a semiconductive resin.

21. An image forming apparatus according to claim 19, in which the semiconductive member of the precharging device is provided with a spacing member to be in contact with the surface of the image carrier at each of corners of an end portion of the semiconductive member in order to leave a clearance of the predetermined distance between the semiconductive member and the surface of the image carrier when the end portion of the semiconductive member is urged towards the surface of the image carrier.

* * * * *